US005329640A

United States Patent [19]

Hourigan

[11] Patent Number: 5,329,640

[45] Date of Patent: Jul. 19, 1994

[54] CUSHIONED SOCK

[76] Inventor: James T. Hourigan, 938 Denmeade Walk, Marietta, Ga. 30064

[21] Appl. No.: 45,729

[22] Filed: Apr. 14, 1993

[51] Int. Cl.[5] ..... A41B 11/00

[52] U.S. Cl. ..... 2/239; 2/267; 2/DIG. 3; 2/DIG. 10

[58] Field of Search ..... 2/239, 19, 267, DIG. 3, 2/DIG. 10, 2, 88, 93, 29

[56] References Cited

U.S. PATENT DOCUMENTS

| | | | |
|---|---|---|---|
| 882,686 | 3/1908 | Ireland et al. | 2/DIG. 3 |
| 2,121,702 | 6/1938 | Larkin | 2/DIG. 3 |
| 2,582,648 | 1/1952 | Mowbray | 2/239 |
| 2,632,176 | 3/1953 | Mitchell | 2/DIG. 3 |
| 2,638,601 | 5/1953 | Bullard, III | 2/239 |
| 5,113,530 | 5/1992 | Smith | 2/19 |

*Primary Examiner*—Clifford D. Crowder
*Assistant Examiner*—Gloria Hale

[57] ABSTRACT

An adjustably cushioned sock wherein a plurality of flexible bladders are provided internally of the sock to receive and retain variable amounts of air therein; pumps to variably supply air to the internal flexible bladders; and a release value to permit such air contained within the flexible internal bladders to be variably exhausted therefrom.

7 Claims, 4 Drawing Sheets

FIG 1
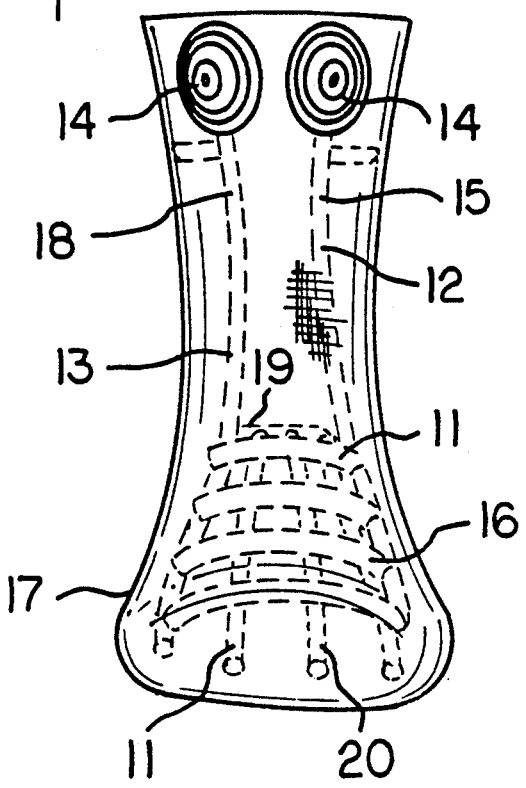
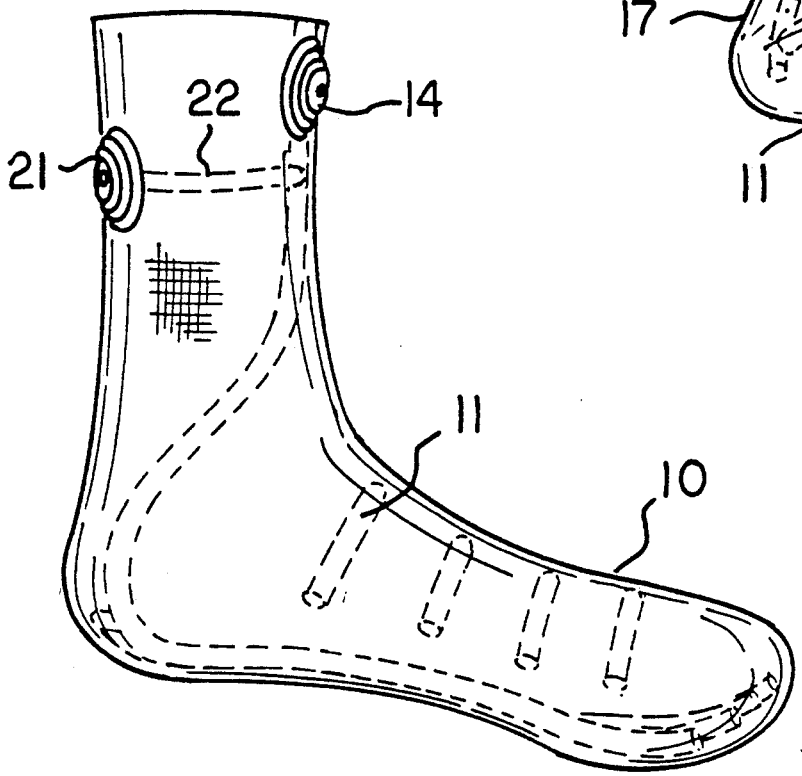
FIG 2

FIG 5
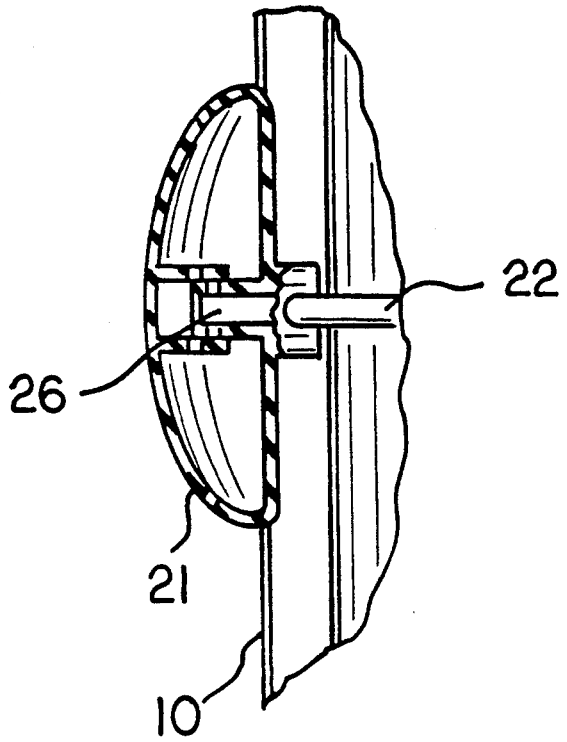
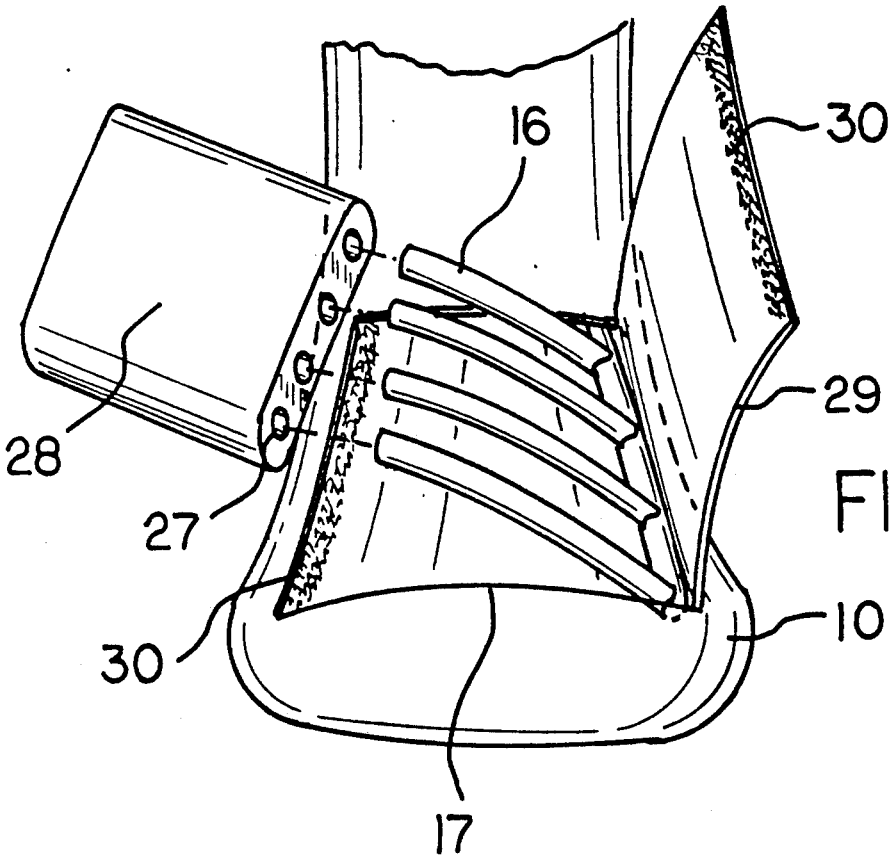
FIG 6

CUSHIONED SOCK

BACKGROUND OF THE INVENTION

1. Field of the Invention

The present invention relates to socks and more particularly pertains to socks which may be adjustably cushioned to maximize wearer comfort.

2. Description of the Prior Art

The use of cushioned socks is known in the prior art. More specifically, means heretofore devised and utilized for the purpose of cushioning socks are known to consist basically of familiar, expected and obvious structural configurations, notwithstanding the myriad of designs encompassed by the crowded prior art which have been developed for the fulfillment of countless objectives and requirements. More specifically, the prior art has utilized multiple layers of padding to cushion, generally, the soles of such socks as shown in U.S. Pat. No. 4,520,635 wherein terry loops are provided to form a "cushion foot" or U.S. Pat. No. 4,206,515 wherein a padded bottom portion of latex is secured to the bottom of a sock. U.S. Pat. No. 4,057,981 likewise utilizes terry loops to cushion the instep portion of a sock. All of these approaches provide cushioning where and as the sock manufacturer decides is important but leave the wearer unable to adjust such cushioning to fit his particular needs.

In this respect, the sock according to the present invention substantially departs from the conventional concepts and designs of the prior art, and in so doing provides means for adjustably controlling the cushioning of the sock to the wearer's specification.

Therefore, it can be appreciated that there exists a continuing need for new and improved socks which can be more comfortably cushioned. In this regard, the present invention substantially fulfills this need.

SUMMARY OF THE INVENTION

In view of the foregoing disadvantages inherent in the known types of socks now present in the prior art, the present invention provides an improved sock construction wherein the same can be utilized to adjustably cushion the foot of the wearer. As such, the general purpose of the present invention, which will be described subsequently in greater detail, is to provide a new and improved cushioned sock which has all the advantages of the prior art socks and none of the disadvantages.

To attain this, the present invention essentially comprises an adjustably cushioned sock wherein a plurality of flexible means are provided internally of the sock to receive and retain variable amounts of air therein; means to variably supply air to said internal flexible means; and further means to permit such air contained within said flexible internal means to be variably exhausted therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cushioned sock which has all the advantages of the prior art socks and none of the disadvantages.

It is another object of the present invention to provide a new and improved cushioned sock which may be easily and efficiently manufactured and marketed.

It is a further object of the present invention to provide a new and improved cushioned sock which is of a durable and reliable construction.

An even further object of the present invention is to provide a new and improved cushioned sock which is susceptible of a low cost of manufacture with regard to both materials and labor, and which accordingly is then susceptible of low prices of sale to the consuming public, thereby making such socks economically available to the buying public.

Still yet another object of the present invention is to provide a new and improved cushioned sock which provides in the apparatuses and methods of the prior art some of the advantages thereof, while simultaneously overcoming some of the disadvantages normally associated therewith.

Still another object of the present invention is to provide a new and improved adjustably cushioned sock.

Yet another object of the present invention is to provide a new and improved sock wherein the wearer may adjust the cushioning thereof.

Even still another object of the present invention is to provide a new and improved air cushioned sock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front plan view of a sock of the present invention showing the interior construction thereof in dashed lines.

FIG. 2 is a side plan view of the sock of FIG. 1.

FIG. 5 is a sectional view on line 5—5 of FIG. 3.

FIG. 6 is an exploded top view of a sock showing a modification of the present invention.

DESCRIPTION OF THE PREFERRED EMBODIMENT

Figure 3:
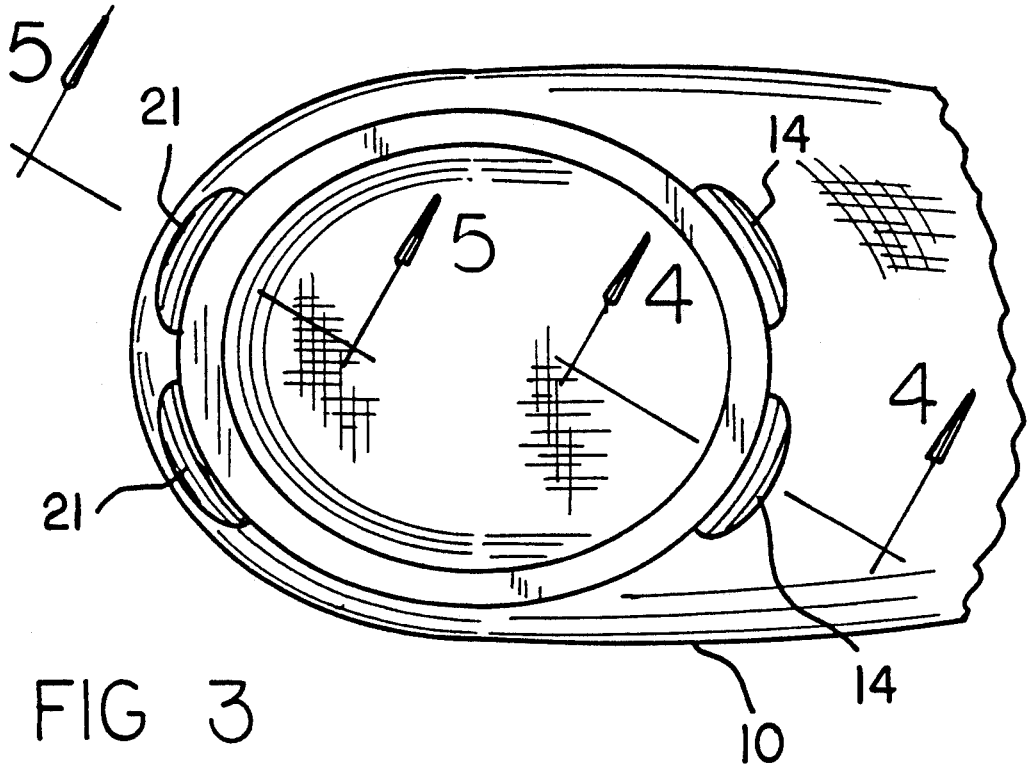
FIG. 3 is a top plan view of the sock of FIGS. 1 and 2.

With reference now to the drawings, and in particular to FIG. 1 thereof, a new and improved sock embodying the principles and concepts of the present invention and generally designated by the reference numeral 10 will be described.

The present invention is illustrated herein as a crew length sock, i.e. worn below the calf of the leg. The sock 10 is shown in FIG. 1 with the means comprising the present invention shown in dashed lines. Basically such means consists of a plurality of flexible, inflatable tubing 11 secured between two fabric layers within the sock 10. Such tubing 11 is formed so as to constitute two separate independent circuits 12 and 13, each with a small, simple, double check valve finger pump 14 incorporated into such circuit for inflating thereof. The flexible tubing 11 forming circuit 12 consists of the feeder tube 15 from one of inflation pumps 14 and a plurality of closed end tubes 16 connected to feeder tube 15 which serves as a manifold to distribute air from pump 14 into closed end tubes 16. Tubes 16 as shown in this FIG. 1 are disposed generally laterally to the length direction of the foot portion 17 of sock 10 and are incorporated within the upper portion thereof. Hence tubes 16 will extend over the top of a foot inserted into sock 10 and when inflated will serve to cushion the instep and ankle. The second circuit 13 has a similar feeder tube 18 having a portion 19 thereof extending transversely to serve another plurality of closed end tubes 20 extending longitudinally along the base of the sock 10 and enclosed within the fabric material forming the sole of sock 10, hence providing cushioning for the heel and ball of the wearer's foot.

As shown in FIG. 2, deflating release valves 21 are positioned at the rear of the calf portion of sock 10 and connected into circuits 12 and 13 by tubing 22 (and a similar tubing on the opposite side of sock 10 not visible in this drawing).

Figure 4:
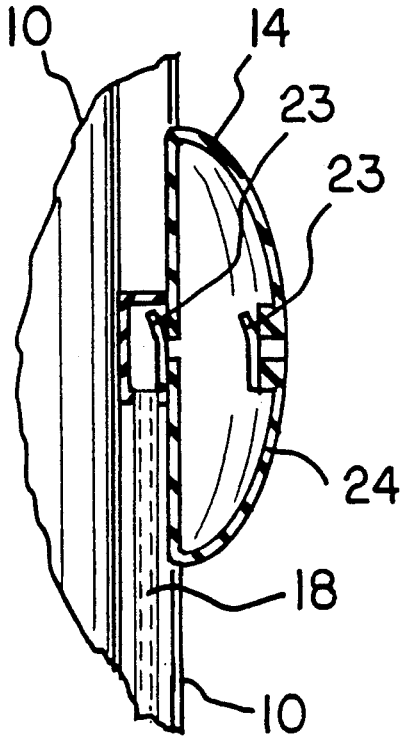
FIG. 4 is a sectional view on line 4—4 of FIG. 3.

FIG. 3 shows the relationship of inflation pumps 14 and deflation release valves 21 on the outside of the calf portion of sock 10, while FIGS. 4 and 5 show the mechanisms of such pumps and release valves.

FIGS. 4 illustrates in cross section the pump 14 showing a pair of simple check valves 23 therein operated by finger pressure on the resilient body 24 of valve 14 to force air from the body of pump 14 into feeder tube 18 enclosed within the fabric of sock 10 and thence into circuit 13 as described above.

FIG. 5 shows in cross section one of the release valves 21, again formed of resilient, deformable material such as plastic or the like and secured to the outer surface of sock 10. The valve body 25 when depressed by finger pressure opens passage 26 to allow air to escape from the connecting tube 22 and thence from circuit 12 and 13 as the case may be.

Figure 7:
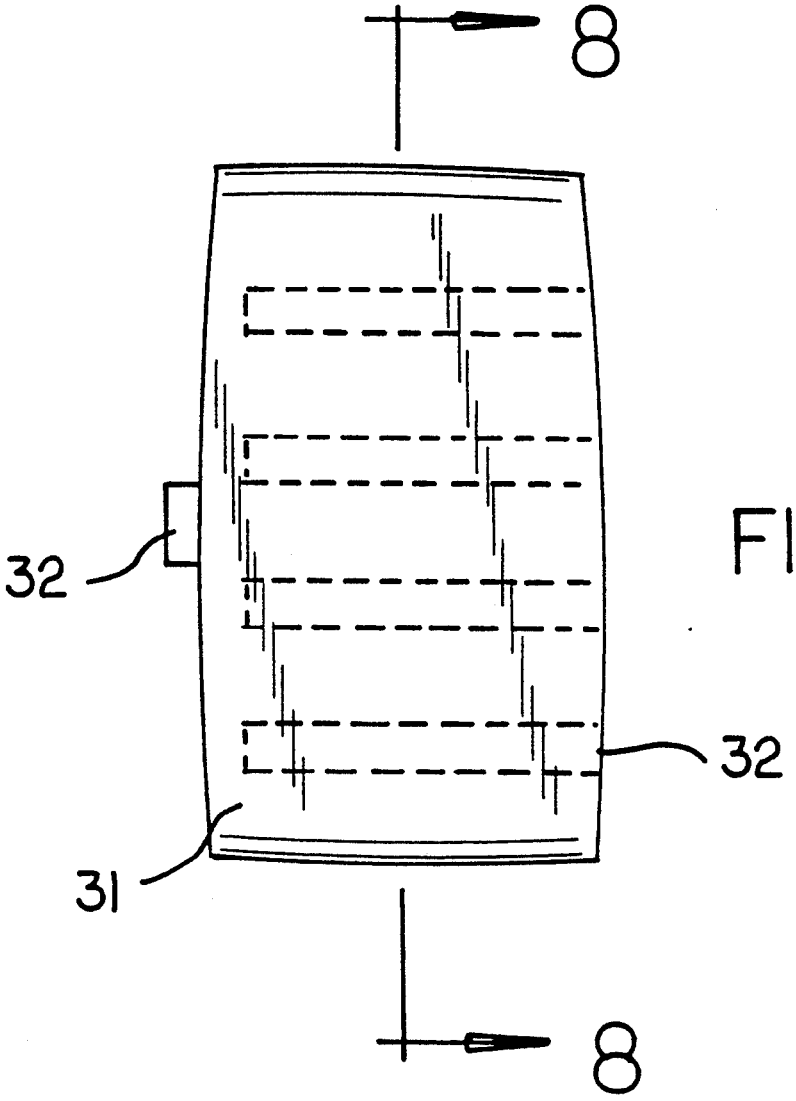
FIG. 7 is a top plan view of a still additional modification.
Figure 8:
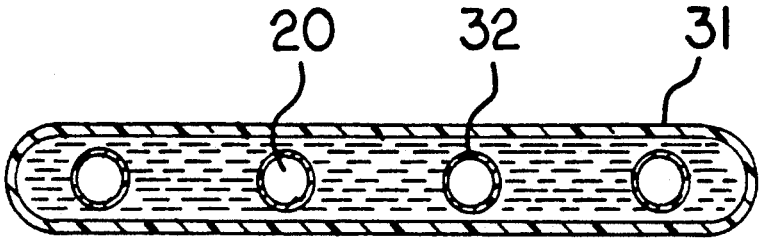
FIG. 8 is a sectional view of line 8—8 of FIG. 7.

FIGS. 6, 7, and 8 show slightly modified structure for use in the present invention. In FIG. 6, the closed end tubes 16 of circuit 12 extending across the top of the foot 17 of sock 10 are inserted into accepting tubular chambers 27 in thin pad 28 of compressible and resilient material such as open-cell foam, and the same is secured inside the fabric of the upper surface of the foot 17 of sock 10. As shown in this drawing a fabric flap 29 may be formed in the top portion of foot 17 to permit replacement of pad 28 should it become worn. Such flap 29 is secured to the rest of the sock 10 by hook and loop fasteners 30. Inflating tubes 16 will cause an increase in density of pad 28 and conversely, releasing pressure therein will soften pad 28.

FIG. 7 shows a similar type modification preferably used with circuit 13 on the sole portion of foot 17 of sock 10. Again a thin pad 31 is provided with resilient tubular chambers 32 adapted to receive the closed end tubes 20 therein. In this case, pad 31 is made of waterproof fabric such as thin rubber, coated nylon or the like and is hollow except for such chambers 32. Fill means 32 are provided to communicate from the outer surface of sock 10 to the interior of pad 31 and to permit the introduction of water or other fluid therein. As shown in FIG. 8, when closed end tubes 20 are in place in chambers 32 the water 33 within chamber 31 will substantially fill such chamber 32 when air pressure is within tubes 20. By releasing the pressure within tubes 20 as described above, the water will not completely fill chamber 32 as such tubes 20 collapse. Since water is not compressible, pumping air into tubes 20 will permit the sole of the sock to become extremely firm.

Socks of the present invention can be used with a variety of different shoes in contrast to the inflatable sneakers currently available. Likewise these socks can be used to compensate for slight misfits in shoes by controlling the amount and location of the inflation therein. Preferably socks of the present invention are of the lower or crew type and are formed of a cotton and wool blend although obviously other designs and fabrics may be used if desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustably cushioned sock having a cuff portion adapted to extend above the ankle, an ankle portion, an instep portion, and a sole portion comprising:

an interior layer and an exterior layer of fabric material forming said sock;

first and second separate air inflatable bladders disposed between said interior and exterior layers of fabric material to form separate circuits adapted to receive and retain air therein;

first and second finger-operated air pumps for each of said circuits, respectively, mounted on said exterior layer of said sock;

said first inflatable bladder being adapted for receiving and retaining air within the fabric layers of said sock over said instep and ankle portions of said sock;

said second inflatable bladder being adapted for receiving and retaining air within the fabric layers of said sock making up said sole portion of said sock; and flexible manifold tubing disposed within said first and second layers of material of said sock to feed air from each said air pump into said first and said second bladders, respectively.

2. A sock as in claim 1 wherein flexible tubing is provided connecting each of said circuits to a finger-operated exhaust valve mounted on the surface of said sock.

3. The cushioned sock of claim 1 wherein at least one of said first and second inflatable bladders comprises a plurality of closed-end flexible tubing members disposed between said layers of fabric material.

4. The cushioned sock of claim 1 wherein each of said first and second inflatable bladders comprises a plurality of closed-end flexible tubing members disposed between said layers of fabric material.

5. The cushioned sock of claim 1 wherein at least one of said first or second finger-operated air pumps is located on said cuff portion of said sock.

6. The cushioned sock of claim 1 further including a finger-operated air release valve connected to at least one of said first or second inflatable bladders.

7. The cushioned sock of claim 1 further including first and second finger-operated air release valves connected to each of said first or second inflatable bladders, respectively, said first and second finger-operated air release valves being mounted on said exterior layer of fabric material.

* * * * *